US008459450B1

(12) United States Patent
Whitaker et al.

(10) Patent No.: US 8,459,450 B1
(45) Date of Patent: Jun. 11, 2013

(54) FORMULA BOTTLE

(75) Inventors: Kevin Whitaker, Beverly Hills, CA (US); Juergen Dold, Manhattan Beach, CA (US)

(73) Assignees: Kevin Whitaker, Beverly Hills, CA (US); Juergen Dold, Manhattan Beach, CA (US)

( * ) Notice: Subject to any disclaimer, the term of this patent is extended or adjusted under 35 U.S.C. 154(b) by 105 days.

(21) Appl. No.: 13/240,888

(22) Filed: Sep. 22, 2011

(51) Int. Cl.
*B65D 1/04* (2006.01)
*A61J 9/00* (2006.01)
*A61J 9/08* (2006.01)

(52) U.S. Cl.
USPC ..... 206/219; 215/6; 215/11.1; 215/1.4; 215/11.5; 215/11.6

(58) Field of Classification Search
USPC ..... 215/6, 11.1–11.6; 206/219
See application file for complete search history.

(56) References Cited

U.S. PATENT DOCUMENTS 4,779,722 A 10/1988 Hall
4,979,629 A 12/1990 Askerneese
5,419,445 A * 5/1995 Kaesemeyer ..... 215/11.1
5,950,689 A * 9/1999 Varlet ..... 141/22
7,036,975 B2 5/2006 Renz
7,331,478 B2 2/2008 Aljadi
7,484,633 B1 * 2/2009 Moher ..... 215/11.1
7,523,822 B2 4/2009 Sharon
7,810,661 B2 10/2010 Murphy
7,850,027 B2 12/2010 Hayes et al.
8,136,660 B2 * 3/2012 Sharon ..... 206/221
2009/0178940 A1 7/2009 Said
2010/0072160 A1 3/2010 Hayes
2010/0213085 A1 8/2010 Belnap
2010/0213156 A1 8/2010 Belnap
2011/0100945 A1 5/2011 Gutierrez
2011/0114589 A1 5/2011 Bathan et al.

* cited by examiner

*Primary Examiner* — Anthony Stashick
*Assistant Examiner* — Jennifer Castriotta
(74) *Attorney, Agent, or Firm* — Richard S Erbe

(57) ABSTRACT

A formula bottle includes two separate sealed chambers, a liquid chamber and a formula chamber. A first seal seals the two chambers from one another and a second seal seals the formula chamber from the nipple on the formula bottle. Rotation of the liquid chamber counterclockwise opens the seal between it and the formula chamber, allowing the formula powder and the liquid to mix. Shaking of the bottle causes the two components to mix completely. In order for the mixed formula to be dispensed to a feeding infant, a bottle collar, which secures the nipple to the formula bottle, is rotated counterclockwise to open the second seal to allow an infant to feed.

9 Claims, 7 Drawing Sheets

FORMULA BOTTLE

RELATED APPLICATIONS

Not applicable.

BACKGROUND OF THE INVENTION

1. Field of the Invention

The present invention relates to the field of storage and mixing of two components contained within two separately-sealed compartments, and more particularly to storage and mixing of infant formula in a two-compartment mixing device.

2. General Background and State of the Art

Baby bottles have long been used to deliver formula and other nutritional liquids to infants and small children. The traditional feeding bottle has a rigid body having an open upper end, a nipple and a fastening ring used to secure the nipple to the open end of the body.

The traditional bottle does not provide an efficient and effective means for mixing powdered baby formula with a liquid. The following steps are required to mix powdered formula with a liquid in a traditional baby bottle: (1) add a specified or recommended amount of liquid to the bottle; (2) add a certain amount of powdered formula; (3) attach the nipple to the bottle with the fastening ring; and (4) shake the bottle until the formula is adequately dissolved in the liquid.

There are several drawbacks associated with providing mixed formula using a traditional baby formula bottle. Undissolved lumps of powdered formula are often formed, leading to clumping or caking of the formula of the nipple and impeding the free flow of formula. This situation is wasteful and may cause the feeding baby to take air into his or her system, which can lead to severed discomfort.

Traditional baby formula bottles, while useful in a home setting, do not provide a convenient way to mix formula when the infant and the parent(s) are away from home, such as when they are traveling in a motor vehicle, in an airport, in a restaurant, or other public setting. There may not be stable or convenient facilities available in those situations to mix the powdered formula with the liquid.

In many situations it is not practical to bring along a pre-mixed bottle of formula, because over time, the formula may spoil.

It would be desirable, therefore, to provide a baby formula feeding bottle that provides for storing pre-measured amounts of powdered baby formula and liquid in separate compartments for extended periods of time which can be later combined, mixed and dispensed without extensive effort or time consumed.

It would also be desirable that such a baby formula feeding bottle closely resemble a traditional feeding bottle in shape and size so that adult and baby will be made to feel that use of the new baby formula feeding bottle provides a very similar look and feel to the feeding process with which they are both comfortable.

SUMMARY OF THE INVENTION

It is therefore an object of the present invention to provide a novel formula bottle that includes separate storage chambers for powdered formula and liquid that can remain stored for extended periods of time and that can be combined and dispensed with minimal effort.

It is another object of the present invention to provide a novel formula bottle that includes a leak-proof seal that separates the formula powder from the liquid that can easily be released by external means with minimal effort.

A further object of the present invention is to provide a novel formula bottle that includes a leak-proof seal to prevent liquid from leaking into the nipple during storage and transport and to prevent formula powder from caking or clumping inside the nipple during the mixing process.

Still a further object of the present invention is to provide a novel formula bottle that facilitates easy loading of powdered formula and liquid into their separate storage chambers.

Yet another object of the present invention is to provide a novel formula bottle that is easy to assemble and disassemble for use, cleaning and reuse.

Still another object of the present invention is to provide a novel formula bottle that is relatively close in shape and size to that of traditional baby feeding bottles.

A further object of the present invention is to provide a novel formula bottle that has a minimal number of separate parts.

It is yet another object of the present invention to provide a novel formula bottle that is cost effective to manufacture and allows manufacturing tolerances to be easily met.

Another object of the present invention is to provide a novel formula bottle that has a high perceived value point of difference to traditional baby feeding bottles in form, materials, look and feel (e.g., sleek and modern).

Still a further object of the present invention is to provide a novel formula bottle that is easy to use.

Yet another object of the present invention is to provide a novel formula bottle that is safe for use and in compliance with applicable statutes, regulations and practices.

These and other objectives are achieved by the present invention. In accordance with the invention, a formula bottle includes separately sealed chambers, one containing liquid (in most cases water) and one chamber containing powdered formula. The chambers of the formula bottle according to the present invention are sealed from one another by means of a first sealing means. The first sealing means comprises a sealing plate attached to the inner surface of the formula chamber that works in conjunction with a first seal that is mounted in one end of the liquid chamber and extends into the formula chamber. The sealing plate and the first seal are in axial alignment with one another and with an imaginary axis of symmetry extending through the formula bottle.

The formula chamber is sealed from a feeding nipple by means of a second sealing means having a ventilation disc that works in conjunction with a second seal mounted in one end of the formula chamber. The ventilation disc and the second seal are in axial alignment with one another. The nipple is secured to the formula chamber by means of a bottle collar.

The liquid chamber and the formula chamber are connected to one another by means of threads on the outer surface of the liquid chamber and the inner surface of the formula chamber. Opening and closing the first sealing means between the two chambers is accomplished by rotating the liquid chamber with respect to the formula chamber. A first registration pin disposed on the outer surface of the liquid chamber cooperates with a first registration aperture and first registration slot in the formula chamber to properly position the two chambers for mixing the liquid and powdered formula and for also sealing one chamber from the other.

The formula chamber and the bottle collar are connected to one another by means of threads on the outer surface of the formula chamber and the inner surface of the bottle collar. Opening and closing the second sealing means between the formula chamber and the nipple is accomplished by rotating the bottle collar with respect to the formula chamber. A second registration pin disposed on the outer surface of the formula chamber cooperates with a second registration aperture and second registration slot in the bottle collar to properly position the formula chamber and the nipple for allowing flow of the mixed formula and for also for sealing the formula chamber from the nipple.

The ventilation disc includes a plurality of ventilation channels where the nipple flange rests on the ventilation disc to allow for air intake to the bottle while the infant is feeding to eliminate negative pressure build-up; this is an anti-colic feature.

The first step in the use of the formula bottle of the present invention is to place an appropriate amount of liquid into the liquid chamber. Next, the first seal is inserted into one end of the liquid chamber.

The formula chamber is then disposed over the liquid chamber and first seal. The liquid chamber is rotated clockwise with respect to the formula chamber until the two chambers are fully connected and sealed from one another, with the first register pin engaged with the first registration aperture.

Formula is then placed into the formula chamber and the second seal is then placed into one end of the formula chamber.

The next step in the operation of the formula bottle is to place the ventilation disc on top of the second seal. Then the nipple is inserted into the bottle collar.

The bottle collar and nipple are then placed over the top of the formula chamber, second seal, and ventilation disc. The bottle collar is then rotated clockwise until the nipple and formula chamber are sealed from one another, with the second register pin engaged with the second registration aperture.

With the components assembled as described and the formula bottle of the present invention fully assembled, the liquid chamber is rotated from a closed (sealed) position counterclockwise with respect to the formula chamber to open the formula bottle to the "mix" position, with the first register pin engaged with the first registration slot. Then the bottle is shaken until the liquid and the formula powder are thoroughly mixed. At this point, while the formula has been mixed, the nipple is still sealed so that there is no mixed formula dispensed until desired.

To dispense the mixed formula, the bottle collar is rotated counterclockwise with respect to open the formula bottle to a "drink" position, with the second registration pin engaged with the second registration slot. Mixed formula can now be dispensed from the bottle to the feeding infant.

Further objects and advantages of this invention will become more apparent from the following description of a preferred embodiment of the invention, which, taken in conjunction with the accompanying drawings, will illustrate, by way of example, the principles of the invention.

BRIEF DESCRIPTION OF THE DRAWINGS

The foregoing and other aspects and advantages of the present invention will be better understood from the following detailed description of an exemplary embodiment of the invention with reference to the drawings in which.

DETAILED DESCRIPTION OF THE PREFERRED EMBODIMENT OF THE INVENTION

In the following description of the invention, reference is made to the accompanying drawings, which form a part thereof, and in which is shown, by way of illustration, an exemplary embodiment illustrating the principles of the formula bottle of the present invention and how it may be practiced. It is to be understood that other embodiments may be utilized to practice the present invention and structural and functional changes may be made thereto without departing from the scope of the present invention.

Figure 1:
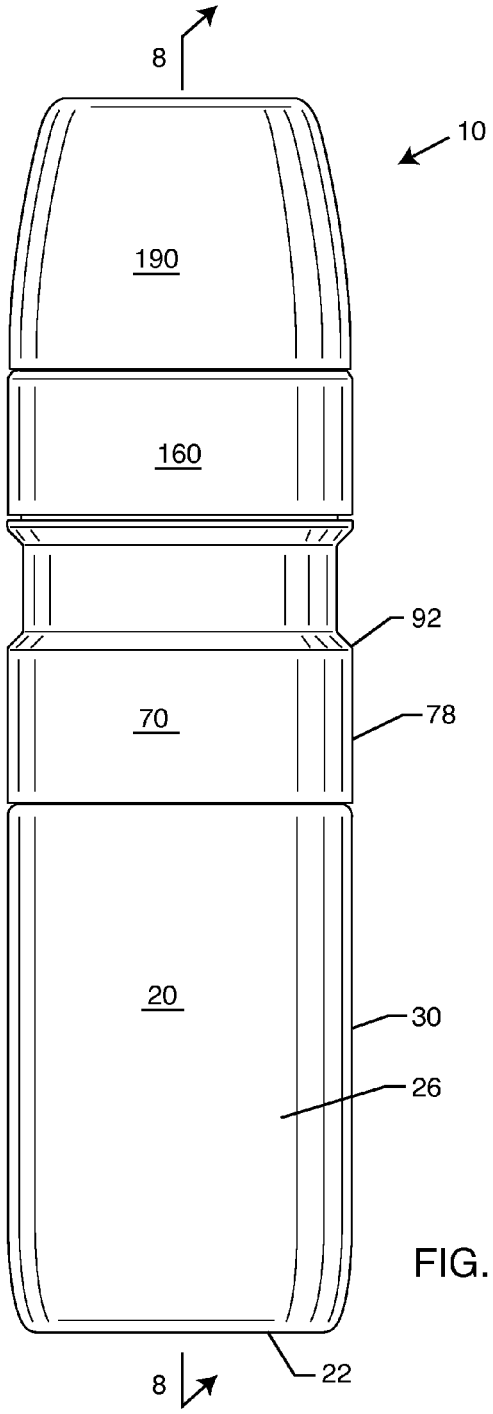
FIG. 1 illustrates an elevational view of an exemplary formula bottle according to the present invention.
Figure 2:
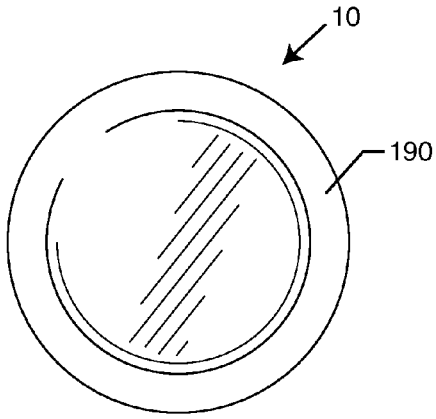
FIG. 2 illustrates a top view of an exemplary formula bottle according to the present invention.
Figure 3:
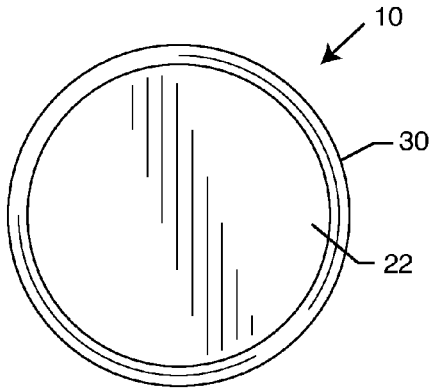
FIG. 3 illustrates a bottom view of an exemplary formula bottle according to the present invention.
Figure 4:
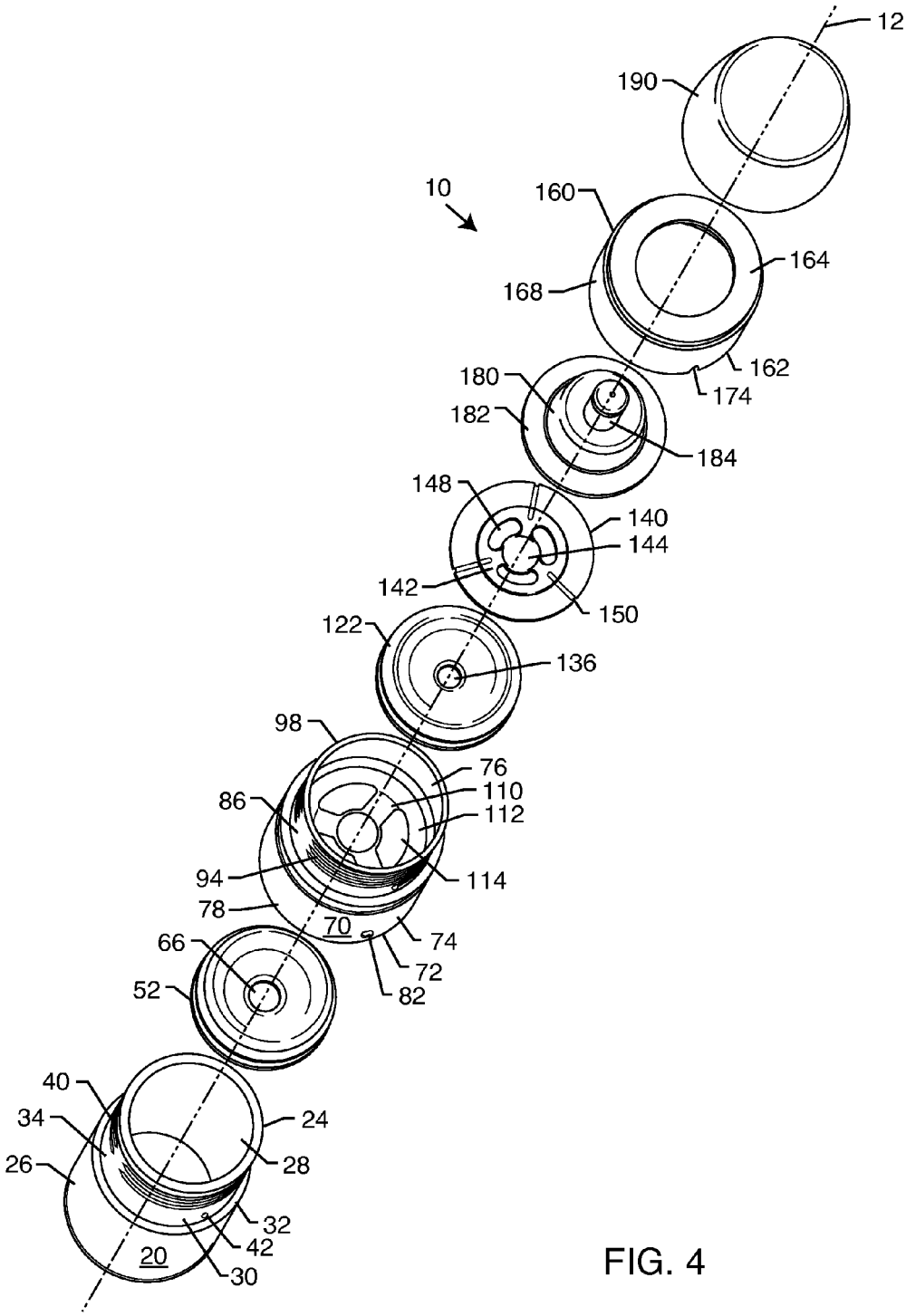
FIG. 4 illustrates an exploded perspective view of an exemplary formula bottle according to the present invention.
Figure 5:
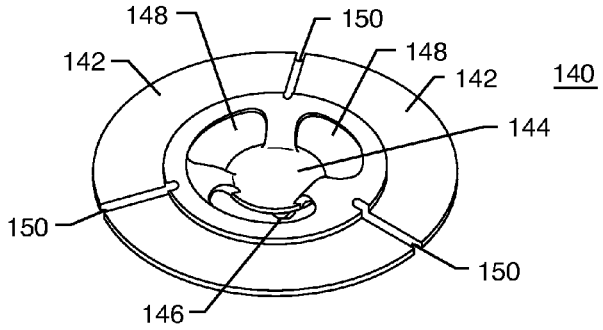
FIG. 5 illustrates a perspective view of the ventilation disc for use with an exemplary formula bottle according to the present invention.
Figure 6:
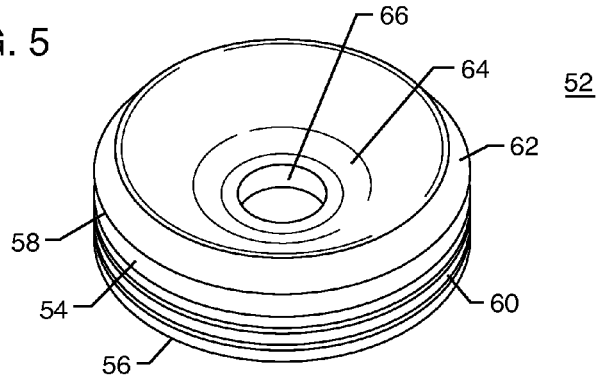
FIG. 6 illustrates a perspective view of the first seal for use with an exemplary formula bottle according to the present invention.
Figure 7:
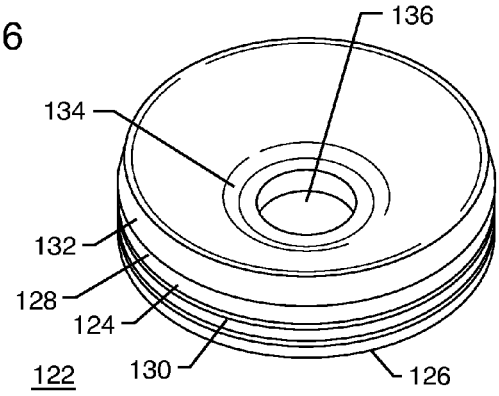
FIG. 7 illustrates a perspective view of the second seal for use with an exemplary formula bottle according to the present invention.
Figure 8:
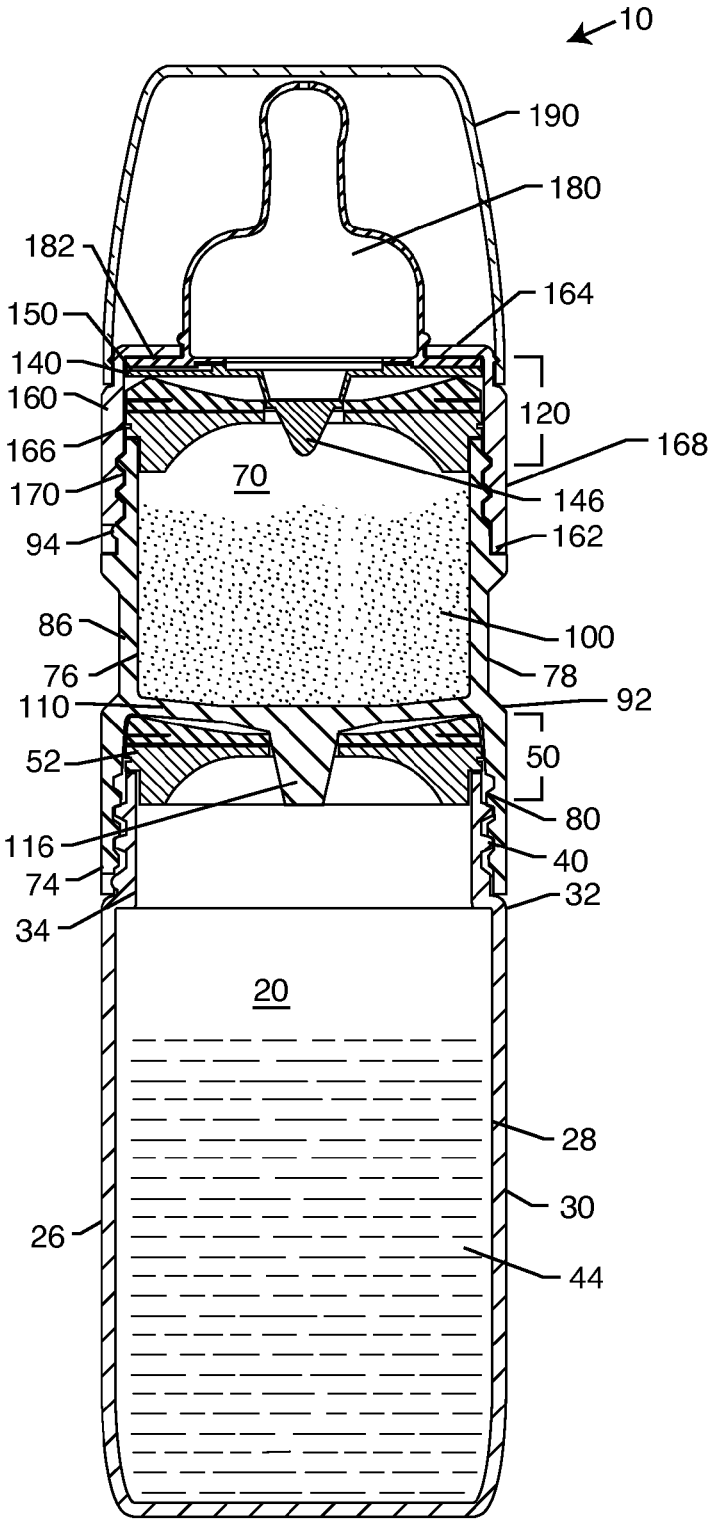
FIG. 8 illustrates a sectional side view of an exemplary formula bottle according to the present invention, with the first and second sealing means closed and the formula bottle is in its closed position.
Figure 9:
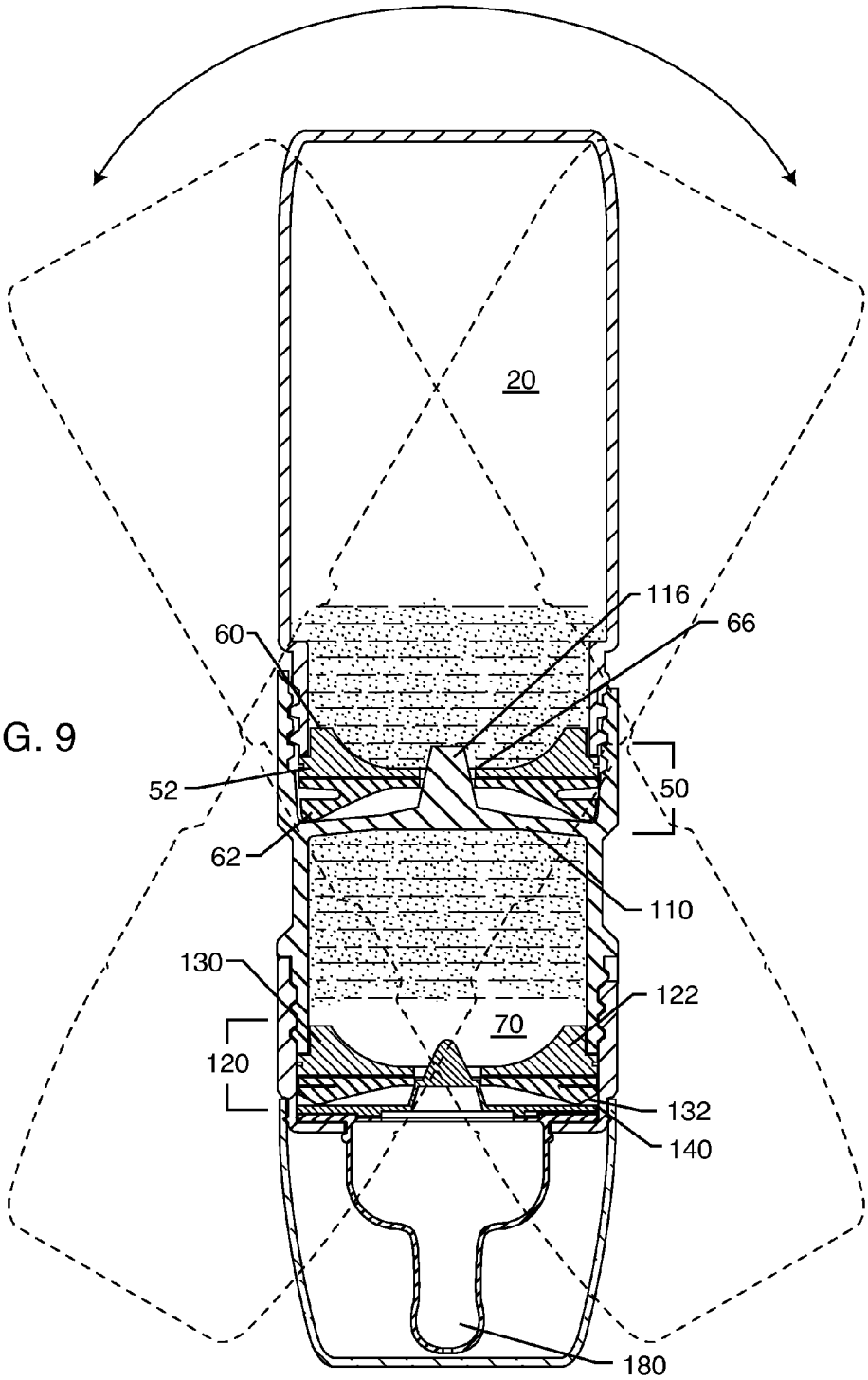
FIG. 9 illustrates a sectional side view of an exemplary formula bottle according to the present invention, with the first sealing means opened and the second sealing means closed and the formula bottle is in its mix position.
Figure 10:
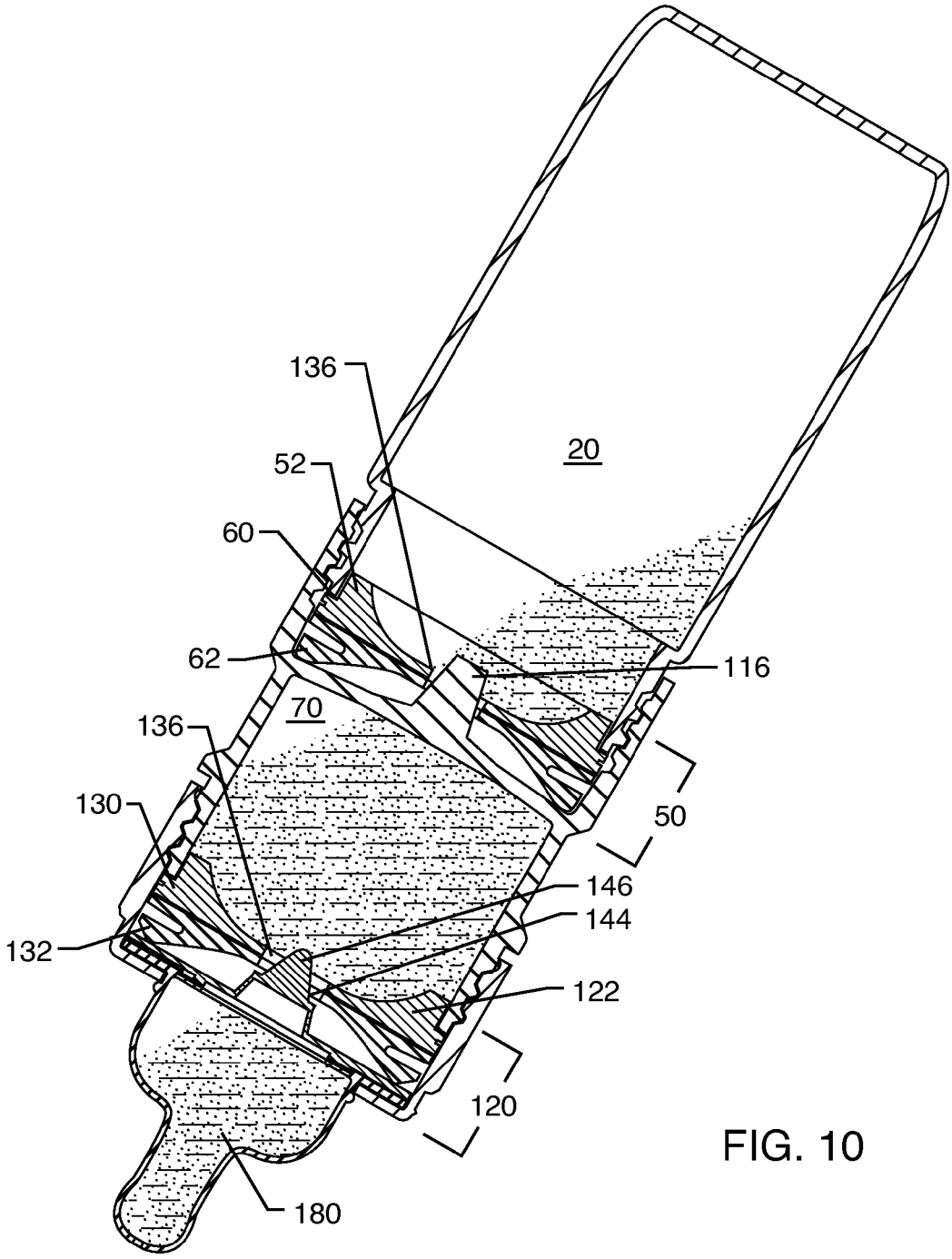
FIG. 10 illustrates a sectional side view of an exemplary formula bottle according to the present invention, with the first sealing and second sealing means open and the formula bottle is in its drink position.

A formula bottle according to a preferred embodiment of the present invention is illustrated in the included drawing figures and is indicated generally by the numeral 10. FIGS. 1-4 and 8-10 illustrate the main components of formula bottle 10. FIGS. 8-10 also illustrate the operating positions of formula bottle 10, those positions being "closed", "mix", and "drink".

Formula bottle 10 includes liquid chamber 20, formula chamber 70, bottle collar 160, nipple 180, and cap 190, which are axially aligned with respect to axis of symmetry 12. Liquid chamber 20 is generally cylindrical in shape and holds liquid 44. Liquid chamber 20 includes closed end 22, open end 24, inner surface 28 and outer surface 30. As illustrated in the drawing figures, liquid chamber 20 further includes large diameter section 26 and small diameter section 34 defined by ledge 32.

Threads 40 on outer surface 30 of liquid chamber 20 provide a means for secure connection with formula chamber 70. Formula chamber 70 is generally cylindrical in shape. Formula chamber 70 holds powdered formula 100 and includes two opposed open ends, first end 72 and second end 98. Formula chamber 70 also includes inner surface 76 and outer surface 78. As illustrated in the drawing figures, formula chamber 70 further includes large diameter section 74 and small diameter section 86 defined by ledge 92. Threads 80 on inner surface 76 engage threads 40 to connect formula chamber 70 and liquid chamber 20, which are in axial alignment with respect to axis 12.

Small diameter section 34 of liquid chamber 20 is overlapped by large diameter section 74 of formula chamber 70 in the closed, mix and drink positions. When formula bottle 10 is to be cleaned, threads 40 and threads 80 can be completely disengaged so that chambers 20 and 70 may be separated to make cleaning of the components of formula bottle 10 easy. Threads 80 and 40 allow liquid chamber 20 and formula chamber 70 to be rotated with respect to one another to allow for assembly as well as for operation of formula bottle 10 for mixing of the formula and for feeding an infant. Assembly and operation of formula bottle 10 will be described later in this specification.

First sealing means 50 forms a seal between liquid chamber 20 and formula chamber 70 to keep liquid 44 and powdered formula 100 separated when formula bottle 10 is in its closed position for storage or transport prior to use. First sealing means 50 includes first seal 52 and sealing plate 110. First seal 52 and sealing plate 110 cooperate to keep liquid 44 and formula 100 separate until a user is ready to mix them.

First seal 52 and it operation are best illustrated in FIGS. 2, 6 and 8-10. First seal 52 is comprised of flexible body 54, which extends between lower end 56 and upper end 58. Lower end 56 terminates in plug 60, which, when formula bottle 10 is assembled, is mounted in open end 24 of liquid chamber 20. Upper end 58 terminates in shoulder 62. Membrane 64 includes opening 66 and is attached to flexible body 54 adjacent to plug 60. First seal 52 is preferably constructed of a food grade flexible rubber or silicone and allows shoulder 62 to move axially with respect to plug 60 as liquid chamber 20 is rotated with respect to formula chamber 70.

Sealing plate 110 is mounted on inner surface 76 of formula chamber 70 and comprises wall 112 and sealing pin 116. A plurality of passageways 114 extend through wall 112. Sealing pin 116 is in axial alignment with opening 66 with respect to axis 12.

When formula bottle 10 is in its closed position, sealing pin 116 closes opening 66. When liquid chamber 20 is rotated counterclockwise with respect to formula chamber 70, first seal 52 expands and moves axially so that opening 66 is no longer closed by sealing pin 116 and formula powder 100 is allowed to drop into liquid chamber 20 to be mixed with liquid 44. In the closed position, shoulder 62 and plug 60 are adjacent one another; when liquid chamber 20 is rotated counterclockwise with respect to formula chamber 70, plug 60 and shoulder 62 become separated by the axial movement of shoulder 62 with respect to plug 60.

Bottle collar 160, which is best illustrated in FIGS. 4 and 8-10, includes open first end 162 and partially open second end 164, and further includes inner surface 166 and outer surface 168. Bottle collar 160 attaches nipple 180 to formula bottle 10 by securing nipple flange 182 with partially open second end 164. Nipple 180 includes dispensing portion 184, which allows mixed formula to be dispensed to a feeding infant when formula bottle 10 is in the drink position.

Threads 94 on outer surface 78 of formula chamber 70 provide a means for secure connection with threads 170 on inner surface 166 of bottle collar 160. Small diameter section 86 of formula chamber 70 is overlapped by bottle collar 160 in the closed, mix and drink positions. When formula bottle 10 is to be cleaned, threads 94 and threads 170 can be completely disengaged so that bottle collar 160, nipple 180 and formula chamber 70 may be separated to make cleaning of the components easy. Threads 94 and 170 allow formula chamber 70 and bottle collar 160 to be rotated with respect to one another to allow for assembly as well as for operation of formula bottle 10 for feeding an infant. Assembly and operation of formula bottle 10 will be described later in this specification.

Second sealing means 120 forms a seal between formula chamber 70 and bottle collar 160, preventing liquid 44 from passing into nipple 180 when formula bottle 10 is being stored, transported, or mixed prior to use. Second sealing means 120 includes second seal 122 and ventilation disc 140. Second seal 122 and ventilation disc 140 cooperate to keep the mixed formula inside of formula bottle 10 until a user is ready to dispense the mixed formula to a feeding child.

Second seal 122 and its operation are best illustrated in FIGS. 4 and 7-10. It should be noted that second seal 122 is identical in structure and function to first seal 52 in every respect except dimensionally. In the formula bottle according to the present invention, the inventors have intentionally built in a dimensional difference between first seal 52 and second seal 122 so that the two seals will always be placed in the same location when formula bottle 10 is assembled for use. Second seal 122 is comprised of flexible body 124, which extends between lower end 126 and upper end 128. Lower end 126 terminates in plug 130, which, when formula bottle 10 is assembled, is mounted in second end 98 of formula chamber 70. Upper end 128 terminates in shoulder 132. Membrane 134 includes opening 136 and is attached to flexible body 124 adjacent to plug 130. Second seal 122 is preferably constructed of a food grade flexible rubber or silicone and allows shoulder 132 to move axially with respect to plug 130 as bottle collar 160 is rotated with respect to formula chamber 70.

Ventilation disc 140 is best illustrated in FIGS. 4, 5 and 8-10 and is mounted on shoulder 132 at second end 98 of formula chamber 70 and comprises wall 142, blocking element 144 and flow accentuating pin 146. A plurality of passageways 148 extend through wall 142. Blocking element 144 is in axial alignment with opening 136 with respect to axis 12.

When formula bottle 10 is in its closed and mixed positions, blocking element 144 closes opening 136 and allows no flow or leakage through nipple 180. When bottle collar 160 is rotated counterclockwise with respect to formula chamber 70, second seal 122 expands and moves axially so that opening 136 is no longer closed by blocking element 144 and mixed formula is allowed to flow through nipple 180. Flow accentuating pin 146, in conjunction with passageways 148, provide means to improve flow of mixed formula from formula chamber 70 to nipple 180. In the closed and mix positions, shoulder 132 and plug 130 are adjacent one another; when bottle collar 160 is rotated counterclockwise with respect to formula chamber 70, plug 130 and shoulder 132 become separated by the axial movement of shoulder 132 with respect to plug 130.

Ventilation disc 140 also includes a plurality of ventilation channels 150 where nipple flange 182 rests on ventilation disc 150 to allow for air intake to formula bottle 10 during feeding, to eliminate negative pressure. This is an anti-colic feature of formula bottle 10.

Assembly and Operation of the Formula Bottle According to the Present Invention:

reference is made to the drawing figures, particularly FIGS. 4 and 8-12, for illustrating the assembly and operation of formula bottle 10. FIG. 8 illustrates formula bottle 10 in the closed position; FIG. 9 illustrates formula bottle 10 in the mix position; and, FIG. 10 illustrates formula bottle 10 in the drink position.

Assembly of formula bottle 10 begins by placing liquid 44 into liquid chamber 20. Liquid 44 is preferably water. Next, first seal 52 is inserted in open end 24 of liquid chamber 20.

Formula chamber 70 is placed over liquid chamber 20 and first seal 52. Liquid chamber is rotated clockwise with respect to formula chamber 70 using the engagement of threads 40 and threads 80 until first registration pin 42 engages first registration aperture 82.

The next step in the assembly process is to load powdered formula 100 into formula chamber 70. Then second seal 122 is inserted into second end 98 of formula chamber 70.

After second seal 122 is in place, ventilation disc 140 is placed on top of seal 122 at shoulder 132. Blocking element 144 and flow acceleration pin 146 extend through and block opening 136. Flow accentuating pin 146 and opening 136 are axially aligned with respect to axis 12.

Figure 11:
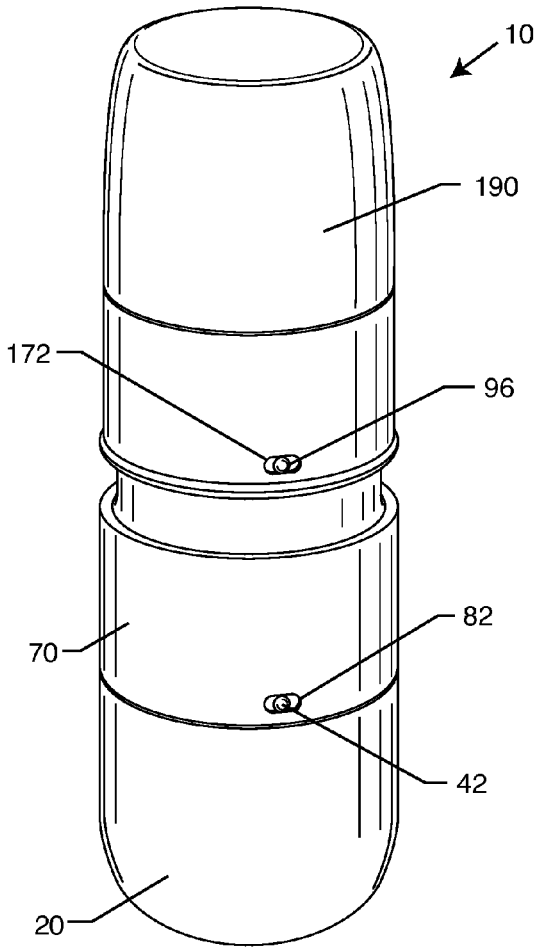
FIG. 11 illustrates an elevational view of an exemplary formula bottle according to the present invention, with the formula bottle in its closed position.

Nipple 180 is then inserted into bottle collar 160; bottle collar 160 and nipple 180 are placed over formula chamber 70, second seal 122, and ventilation disc 140. Bottle collar 160 is then rotated clockwise with respect for formula chamber 70 using the engagement of threads 94 and threads 170. Rotation continues until second registration pin 96 engages with second registration aperture 172. Formula bottle 10 is now in its closed position as best illustrated in FIGS. 8 and 11, and ready for storage and/or transport. Cap 190 is placed over nipple 180.

With formula bottle 10 in the closed position, when it is desired to mix liquid 44 with powdered formula 100 in preparation for feeding, liquid chamber 20 is rotated counterclockwise about formula chamber 70 until first registration pin 42 engages first registration slot 84. Formula bottle 10 is now in the mix position. Shoulder 62 has moved axially with respect to plug 60, allowing opening 66 and sealing pin 116 to separate and permitting powdered formula 100 to enter liquid chamber 20. At this point, a user shakes formula bottle 10 until liquid 44 and powdered formula 100 are thoroughly mixed, as best illustrated in FIG. 9.

Figure 12:
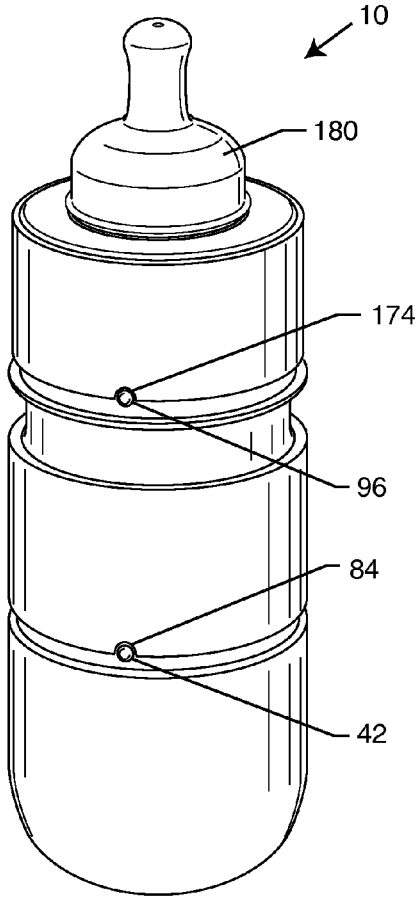
FIG. 12 illustrates an elevational view of an exemplary formula bottle according to the present invention, with the formula bottle in its drink position.

From the mix position, when it is desired to feed an infant, bottle collar 160 is rotated counterclockwise with respect to formula chamber 70 until second registration pin 96 engages second registration slot 174. Formula bottle 10 is now in the drink position. Shoulder 132 has moved axially, allowing opening 136 and blocking element 144 to separate, thus allowing mixed formula to flow from formula chamber 70 to nipple 180. Cap 190 is removed, and the mixed formula can now be dispensed from formula bottle 10 to a feeding infant. This position, called the drink position, is best illustrated in FIGS. 10 and 12.

Assembly, use, and disassembly for cleaning formula bottle 12 is quick and efficient for a user, because formula bottle 10 consists only of eight parts: liquid chamber 20, first seal 52, formula chamber 70, second seal 122, ventilation disc 140, bottle collar 160, nipple 180 and cap 190. Sealing plate 110 is integral with formula chamber 70 and is does not require assembly or disassembly.

The foregoing descriptions of an exemplary embodiment of the present invention have been presented for purposes of enablement, illustration, and description. It is not intended to be exhaustive of or to limit the present invention to the precise forms discussed. There may be, however, other formula and baby feeding bottles not specifically described herein, but with which the present invention is applicable. The present invention should therefore not be seen as limited to the particular embodiment described herein; rather, it should be understood that the present invention has wide applicability with respect to feeding bottles. Such other configurations can be achieved by those skilled in the art in view of the description herein. Accordingly, the scope of the invention is defined by the following claims.

What is claimed is:

1. A formula bottle comprising:
- a generally cylindrical liquid chamber having a closed end, an open end, an inner surface and an outer surface;
- a generally cylindrical formula chamber connected to said liquid chamber, said formula chamber having a first end, a second end, an inner surface and an outer surface;
- a first sealing means forming a seal between said liquid chamber and said formula chamber, wherein said first sealing means further comprises:
  - a first seal, wherein said first seal further comprises:
    - a flexible body having a lower end and an upper end;
    - a plug disposed at said lower end and of said body mounted in said open end of said liquid chamber;
    - a shoulder attached to said upper end of said body;
    - a membrane attached to said body; and
    - an opening in said membrane,
    - whereby, said shoulder moves axially with respect to said plug when said liquid chamber is rotated with respect to said formula chamber; and
  - a sealing plate;
- a bottle collar securing a nipple to said formula chamber; and
- a second sealing means forming a seal between said formula chamber and nipple.

2. The formula bottle according to claim 1, wherein said sealing plate further comprises:
- a wall attached to said inner surface of said formula chamber;
- a plurality of passageways extending through said wall; and
- a sealing pin extending from said wall, said sealing pin disposed in axial alignment with said opening in said membrane.

3. The formula bottle according to claim 1, wherein said second sealing means further comprises:
- a second seal; and
- a ventilation disc.

4. The formula bottle according to claim 3, wherein said second seal further comprises:
- a flexible body having a lower end and an upper end,
- a plug disposed at said lower end and of said body and mounted in said second end of said liquid chamber;
- a shoulder attached to said upper end of said body;
- a membrane attached to said body; and
- an opening in said membrane,
- whereby, said shoulder moves axially with respect to said plug when said bottle collar is rotated with respect to said formula chamber.

5. The formula bottle according to claim 4, wherein said ventilation disc further comprises:
- a wall disposed between said second seal and said collar;
- a blocking element attached to said wall, said blocking element axially aligned with said opening in said membrane; and
- a plurality of passageways extending through said wall.

6. The formula bottle according to claim 5, further comprising a flow accentuating pin extending from said blocking element, said pin disposed in axial alignment with said opening in said membrane.

7. The formula bottle according to claim 4, wherein said ventilation disc further comprises a plurality of ventilation channels.

8. The formula bottle according to claim 1, further comprising:

a first registration pin disposed on said outer surface of said liquid chamber;

a first registration aperture disposed in said formula chamber; and a first registration slot disposed in said formula chamber, whereby, said first registration pin engages said first registration aperture when said liquid chamber and said formula chamber are in a closed position, and whereby, said first registration pin engages said first registration slot when said liquid chamber and said formula chamber are in a mix position.

9. The formula bottle according to claim 1, further comprising:

a second registration pin disposed on said outer surface of said formula chamber;

a second registration aperture disposed in said bottle collar; and a second registration slot disposed in said bottle chamber, whereby, said second registration pin engages said second registration aperture when said liquid chamber and said nipple are in a closed position, and whereby, said second registration pin engages said second registration slot when said liquid chamber and said nipple are in a drink position.

* * * * *